United States Patent [19]

Pawlicki

[11] Patent Number: 5,011,439

[45] Date of Patent: Apr. 30, 1991

[54] SPRING CLIP ELECTRICAL CONNECTOR

[75] Inventor: Jeffrey J. Pawlicki, Downers Grove, Ill.

[73] Assignee: Molex Incorporated, Lisle, Ill.

[21] Appl. No.: 466,810

[22] Filed: Jan. 18, 1990

[51] Int. Cl.[5] ..... H01R 13/187

[52] U.S. Cl. ..... 439/847; 439/854

[58] Field of Search ..... 439/130, 833, 835, 838, 439/823, 842, 847, 848, 851, 854, 855, 859

[56] References Cited

U.S. PATENT DOCUMENTS

| | | | |
|---|---|---|---|
| 2,623,085 | 8/1949 | Gier, Jr. | 439/835 |
| 2,942,231 | 6/1960 | Cornell, Jr. | 439/847 |
| 3,223,963 | 12/1965 | Rarey et al. | 439/847 |
| 4,550,972 | 11/1985 | Romak | 439/851 |
| 4,886,473 | 12/1989 | Germ | 439/847 |

*Primary Examiner*—David L. Pirlot
*Assistant Examiner*—Hien D. Vu
*Attorney, Agent, or Firm*—Louis A. Hecht; Stephen Z. Weiss; Charles S. Cohen

[57] ABSTRACT

An electrical connector assembly is provided for mounting to the pin of a vehicular alternator. The connector includes a terminal having a mating end defining a split cylindrical sleeve. The connector also includes a spring clip having a split cylindrical sleeve that can be telescoped over the split cylindrical sleeve of the terminal to contribute to the spring forces thereof and thus contributing to the radially inward contact forces of the connector. The spring clip further includes a pin engaging portion having an aperture extending therethrough for receiving the pin of the alternator. The pin engaging portion is non-orthogonally aligned to the axes of the split cylindrical sleeves, but can be biased into an orthogonal alignment. The pin engaging portion can be urged into the orthogonal alignment to enable mating and unmating, and will resiliently return toward an unbiased condition wherein edge regions of the aperture therethrough will grippingly engage the pin of the alternator.

13 Claims, 2 Drawing Sheets

SPRING CLIP ELECTRICAL CONNECTOR

BACKGROUND OF THE INVENTION

Electrical connectors for vehicular applications must be able to withstand the high vibrations to which vehicles are subjected almost continuously in use. The connectors also must provide high quality electrical connection through very broad ranges of temperature variations. Additionally, many electrical connections must be splash-proof to ensure at least some protection against environmental moisture. Electrical connectors that are disposed in the engine compartment also must protect against the inadvertent but inevitable manual contact that occurs as an automobile mechanic is trying to access a nearby vehicular component disposed in the crowded engine compartment.

Electrical connectors for vehicular alternators must meet all of the above identified design criteria and further must accommodate extremely high amperage. In particular, electrical connectors for vehicular alternators may carry currents as high as 150 amps. Electrical connectors for such high amperage applications must be fairly massive, with a large surface-to-surface contact, and with a large cross-sectional area and with high normal contact forces.

The typical prior art vehicular alternator includes a threaded stud terminal to which a threaded nut may be selectively connected. The typical prior art terminal for connection to such an alternator includes a mating end effectively defining a generally planar eyelet that is dimensioned to be slidably passed over the threaded stud of the alternator. The opposed end of such a terminal typically will be crimped and/or soldered to the conductor of the wire leading to or from the alternator. The eyelet is maintained in a mated condition on the alternator by the nut which is threaded tightly against the planar portion of the eyelet for securely retaining the terminal on the alternator and for providing the large surface contact area and high contact forces that are desired.

The typical prior art electrical connector for vehicular alternators, and other such threaded nut and stud electrical connectors generally perform very well. However, the threaded components of these prior art connectors are fairly expensive to manufacture. Furthermore, the threaded interconnection adds significantly to assembly time and costs and can make disassembly for periodic repair and maintenance difficult. In this regard, rust, corrosion or accumulated engine compartment deposits can make the threaded disconnection of the nut from the alternator stud extremely difficult and time consuming. Any attempt to provide environmental sealing for such an electrical connection will generally require an entirely separate protection means that is functionally and structurally unrelated to the threaded interconnection to the alternator.

Many prior art electrical connectors rely upon resiliency of the metal to achieve electrical connection. However, it is extremely difficult to achieve the high contact forces with an electrical connector that must also ensure a large surface contact area and a large crosssectional area of metal. Examples of electrical connectors that have attempted to avoid threaded means for achieving electrical connection include: U.S. Pat. No. 3,980,387 which issued to Neidecker on Sept. 14, 1976 which shows a snap-type connector for a battery terminal; U.S. Pat. No. 4,009,924 which issued to Bungo et al. on Mar. 1, 1977 and which shows a spark plug connector; and, U.S. Pat. No. 4,720,157 which issued to Nestor et al. on Jan. 19, 1988 which shows a multi-component electrical connector having a resilient internal contact means.

Other prior art electrical connectors have included spring means which are intended to achieve secure electrical connection without resorting to combinations of threads and nuts. For example, U.S. Pat. No. 4,521,067 issued to Dufresne on June 4, 1985 and shows a battery cable connector having a generally circular spring clip; U.S. Pat. No. 4,470,654 issued to Friedman on Sept. 11, 1984 and shows a complex electrical connector assembly for a battery terminal including an internally disposed coil spring for biasing a movable electrical contact. U.S. Pat. No. 4,385,796 issued to Eriksson on May 31, 1983 and shows a battery terminal post clamp having a complex arrangement of pivoting members which are intended to pivot into secure electrical connection with a battery post, and to alternately and selectively enable release from the battery post.

Still other connectors have included a stamped member having a pair of deflectable arms with apertures extending therethrough. The arms can be biased such that the apertures align with one another to permit insertion of a pin through the aligned apertures. However, when the biasing force on the arms is released, the arms resiliently return to a condition where they bind against the pin inserted through the apertures. Connectors of this type have been used for various low current connector applications where a large surface contact area and high normal contact forces are not essential. Examples of connectors of this general type are shown in U.S. Pat. No. 4,311,359 which issued to Keller on Jan. 19, 1982 and U.S. Pat. No. 3,705,076 which issued to Kinkaid et al. on Dec. 5, 1972.

The prior art further includes the use of clips which perform no direct electrical connection function, but which securely retain the housings of two electrical connectors together. Prior art of this type is shown in U.S. Pat. No. 4,509,813 which issued to Hesse on Apr. 9, 1985.

In view of the above, it is an object of the subject invention to provide a high amperage electrical connector that enables quick connection and disconnection.

It is another object of the subject invention to provide an electric connector for vehicular alternators that can quickly be clipped into connection with a post on the alternator and that can be quickly selectively removed therefrom.

A further object of the subject invention is to provide an alternator connector that can be connected or disconnected to an alternator post manually and without the use of special tooling.

Yet another object of the subject invention is to provide a high amperage electrical connector for use in a high vibration environment while providing a desired degree of environmental protection.

SUMMARY OF THE INVENTION

The subject invention is directed to an electrical connector that enables quick connection and quick disconnection in applications requiring high contact forces, large surface contact area and a large cross-sectional area for the connector terminals. The connector is particularly well suited for a vehicular alternator, and other such high amperage connectors used in high vibration environments.

The connector of the subject invention includes a terminal having a mating end and an opposed wire mounting end. The wire mounting end may comprise a plurality of crimpable arms for crimped engagement to a wire, which typically is a large diameter wire intended for high amperage automotive alternator applications. In this regard, the wire may be a 6 AWG PVC insulated wire. The wire mounting end of the terminal may alternatively or additionally be soldered to the wire. The mating end of the terminal may define a split sleeve dimensioned to slidably engage the alternator pin or post terminal. The split sleeve defining the mating end of the terminal is dimensioned to ensure that the mating end is resiliently deflected during mating to exert radially inward contact forces against the alternator post or pin terminal. The terminal of the subject connector preferably is stamped and formed from a unitary piece of a metallic material that exhibits good electrical conductivity, such as a brass alloy which may be plated with tin. The high degree of electrical conductivity is essential for high amperage applications, such as the vehicular alternator referred to above. However, materials of this type generally do not provide superior resiliency to ensure adequate contact forces with the alternator pin, and in particular to ensure reliable retention on the alternator in the high vibration automotive environment.

To ensure adequate contact force and to positively ensure retention on the alternator, the connector of the subject invention further includes a spring clip which preferably is stamped and formed from a metal material exhibiting desirable resiliency at high temperatures, such as stainless steel. The spring clip includes a female terminal engaging portion and a male terminal engaging portion which may be of unitary construction, or which may define initially separate parts securely connected to one another by welding or other such connecting means. The female terminal engaging portion may define a split sleeve dimensioned to be slidably engaged over the split sleeve of the terminal, and preferably is dimensioned to be in close face-to-face contact with outer surface regions of the terminal split sleeve. Thus, the split sleeve of the spring clip will contribute to the radially inward contact forces exerted by the split sleeve of the terminal to ensure high normal contact forces against the pin terminal of the alternator. The split sleeve may further include means for engaging the terminal of the connector to prevent unintended axial movement therebetween. For example, the terminal of the connector and the spring clip may include mateable detents or bosses.

The male terminal engaging portion of the spring clip may define an aperture extending therethrough for engaging the alternator terminal post or pin. The male terminal engaging portion may be resiliently deflectable relative to the female terminal engaging portion of the spring clip. More particularly, in an unbiased condition, the male terminal engaging portion may be disposed at a non-perpendicular angle to the split sleeve of the female terminal engaging portion. However, the male terminal engaging portion may be biased into an alignment substantially orthogonal to the axis of the split sleeve cylindrical portion of the spring clip. The aperture extending through the male terminal engaging portion of the spring clip may be dimensioned to slidably pass over the male pin terminal of the alternator only when the male terminal engaging portion is deflected from its unbiased condition into orthogonal alignment with the split cylindrical sleeve. However, when the biasing forces on the male terminal engaging portion of the spring clip are released, the male terminal engaging portion will resiliently return to a condition where it bites into the pin passed through the aperture therein.

The spring clip may further include an actuator portion extending unitarily from the male terminal engaging portion. The actuator portion may be selectively actuated to urge the male terminal engaging portion of the spring clip into a position for permitting relative movement between the male terminal of the alternator and the spring clip.

The electrical connector of the subject invention may further include an insulating boot which extends over the terminal and the spring clip. The boot performs an insulating function and an environmental protection function. At least a portion of the boot adjacent to the actuator of the spring clip may be readily deflectable, such that manual pressure exerted on this portion of the boot will urge the spring clip into a condition for enabling selective removal of the connector from the pin terminal to which the connector is mated. The boot may be insert molded around at least a portion of the terminal. Alternatively, the resilient boot may be forcibly urged into secure engagement with a portion of the terminal.

DETAILED DESCRIPTION OF THE PREFERRED EMBODIMENT

Figure 1:
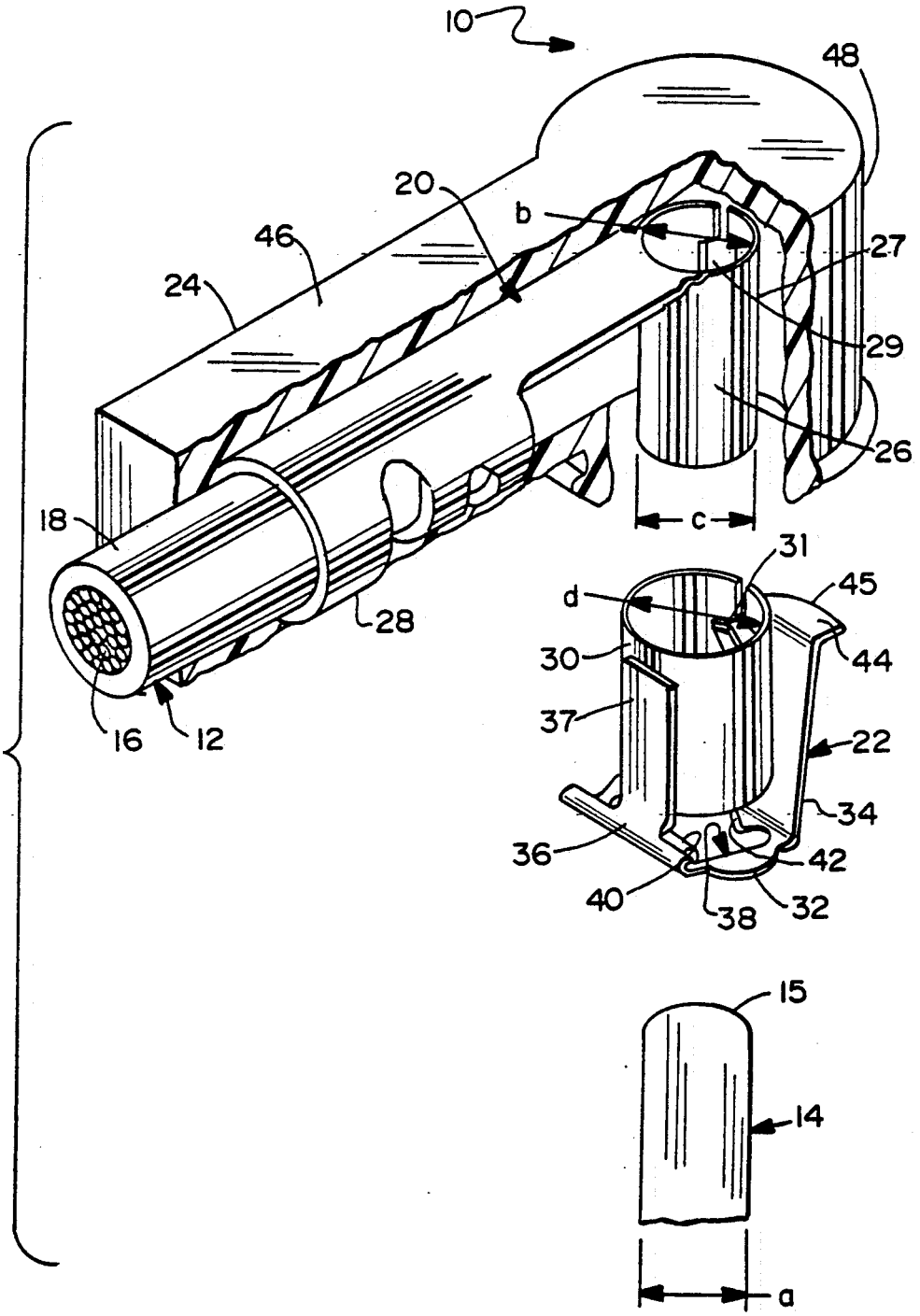
FIG. 1 is an exploded perspective view of the electrical connector assembly shown partly in section.

The electrical connector assembly of the subject invention is identified generally by the numeral 10 in FIGS. 1-6. The electrical connector assembly 10 depicted in FIG. 1 is specifically intended to connect a wire 12 to the pin 14 on a vehicular alternator. It is to be understood, however, that the connector assembly 10 can readily be adapted for other applications, and in particular for other automotive applications or machine tool applications where it is necessary to provide an easily mateable and unmateable electrical connector for use in a high vibration environment and/or for use in an environment subject to high ambient moisture conditions or periodic splashing of liquids. The pin 14 of the alternator is depicted as being of generally smooth cylindrical configuration of diameter "a" with an arcuate convex tip 15. However, certain threaded or non-smooth or non-cylindrical pins may be receivable in the connector assembly of the subject invention.

The wire 12 to which the electrical connector assembly 10 is mounted includes a conductor 16 for accommodating the high current required for a vehicular alternator. In particular, the conductor 16 of the wire 12 may be a 6 AWG wire having a PVC insulation 18 thereon.

The electrical connector assembly 10 includes a female terminal 20, a spring clip 22 which is engageable with and surrounds a portion of the terminal 20 as explained below, and an elastomeric boot 24 which surrounds and protects the assembled terminal 20 and clip 22.

The terminal 20 is stamped and formed from a unitary piece of metal, and preferably is stamped and formed from a highly conductive brass alloy which is tin plated. The terminal 20 defines a mating end 27 and a wire mounting end 28. The wire mounting end 28 includes a plurality of crimpable arms for engaging both the insulation 18 on the wire 12 and the conductor 16 thereof. The wire mounting end 28 extends in a generally longitudinal direction substantially corresponding to the axis of the wire 12.

The mating end 27 of the terminal 20 defines a split cylindrical sleeve having an axis extending substantially orthogonal to the axis defined by the wire mounting end 28 of the terminal 20. The split cylindrical sleeve 26 of the terminal 20 defines an internal diameter "b" and an external diameter "c". The internal diameter "b" is less than the diameter "a" of the pin terminal 14 of the vehicular alternator. Consequently, the mating end 26 of the terminal 20 will be biased outwardly during mating over the rounded convex tip 15 of the pin terminal 14, and will thereby exert generally radially inward contact forces against the pin terminal 14 of the alternator. The mating end 27 further includes a notch 29 for engaging corresponding structure on the spring clip 22 as explained below. As noted above, the terminal 20 preferably is stamped and formed from a brass alloy or other material exhibiting superior electrical conductivity. Materials such as brass, however, do not have sufficient resiliency to achieve the necessary high normal contact forces for achieving and ensuring a high quality electrical connection with the alternator pin terminal 14. These desirably high normal contact forces are obtained by the spring clip 22 as explained further herein.

The spring clip 22 preferably is stamped and formed from stainless steel having a thickness of approximately 0.020 inch. More particularly, the spring clip 22 is stamped and formed to define a female terminal engaging portion 30, a male terminal engaging portion 32 and an actuator 34. The female terminal engaging portion 30 defines a split cylindrical sleeve having a detent 31 for engaging the corresponding notch 29 on the split cylindrical sleeve 26 of the terminal 20. The engagement of notch 29 and detent 31 prevents unintended sliding between the split cylindrical sleeve 26 of the terminal 20 and the female terminal engaging portion 30 of the spring clip 22. The female terminal engaging portion 30 of the spring clip 22 defines an inside diameter "d" which is approximately equal to the external diameter "c" of the split cylindrical sleeve 26 on the terminal 20. As a result, the split cylindrical sleeve defining the female terminal engaging portion 30 of the spring clip 22 can be telescoped over the split cylindrical sleeve 26 defining the mating end of the terminal 20. With the dimensions, the split cylindrical sleeve 30 of the spring clip 22 will closely engage the split cylindrical sleeve 26 of the terminal 20. The stainless steel material from which the spring clip 22 is formed exhibits substantially greater resiliency than the brass material or other such highly conductive material from which the terminal 20 may be formed. As a result, the female terminal engaging portion 30 of the spring clip 22 will substantially contribute to the radially inward contact forces exerted against the pin terminal 14 of the alternator. Specifically, the split cylindrical sleeve 26 of the terminal 20 and the female terminal engaging portion 30 of the spring clip 22 both will be deflected into an expanded cylindrical condition upon insertion over the pin 14. The inward contact forces against the pin 14 thus will be the sum of the forces exerted by the less resilient brass alloy material defining the split cylindrical sleeve 26 and the more resilient stainless steel material defining the female terminal engaging portion 30 of the spring clip 22. These high inward contact forces will substantially contribute to a retention of the terminal 20 on the pin 14. However, as noted above, the vehicular alternator is subject to almost continuous vibrations in use, and it is essential to ensure positive retention of the terminal 20 on the pin 14. This additional retention is assured by the male terminal engaging portion 32 as explained herein.

The male terminal engaging portion 32 of the spring clip 22 includes a hinge 36 and a connecting tab 37 which is resistance welded to an external surface region of the female terminal engaging portion 30. The male terminal engaging portion 32 is generally planar, and lies in a plane that it non-orthogonal to the longitudinal axis of the cylindrical female terminal engaging portion 30. The 0 male terminal engaging portion 32 includes an aperture 38 extending therethrough with generally arcuate gripping edges 40 and 42 defining portions of the periphery of the aperture 38. In particular, the gripping portions 40 and 42 define arcs of a circle and are generally symmetrically disposed relative to the longitudinal axis of the female terminal engaging portion 30. The male terminal engaging portion 32 can be deflected about hinge 36 relative to the tab 37 and the female terminal engaging portion 30 to which the tab 37 is connected. In particular, the male terminal engaging portion 32 can be urged toward the female terminal engaging portion 30 and into alignment substantially orthogonal to the longitudinal axis of the female terminal engaging portion 30 by exerting radially inward biasing forces on the actuator 34.

Figure 2:
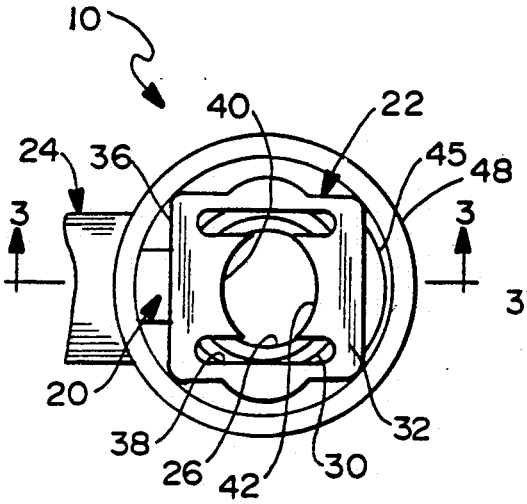
FIG. 2 is an end elevational view of the connector in an unbiased condition.
Figure 3:
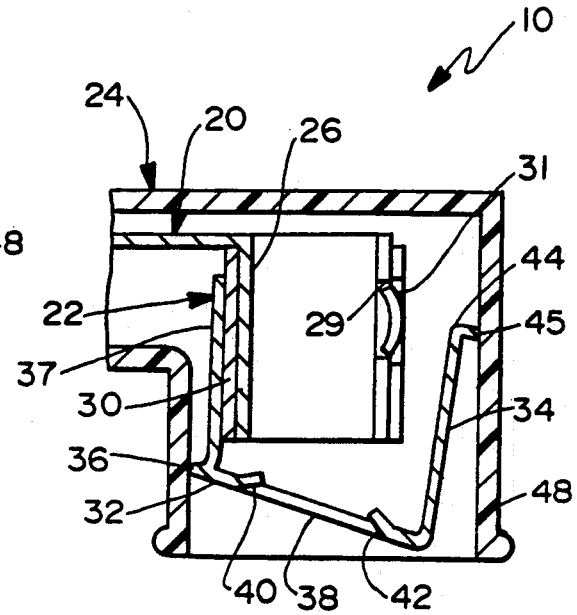
FIG. 3 is a cross-sectional view taken along line 3—3 in FIG. 2.
Figure 4:
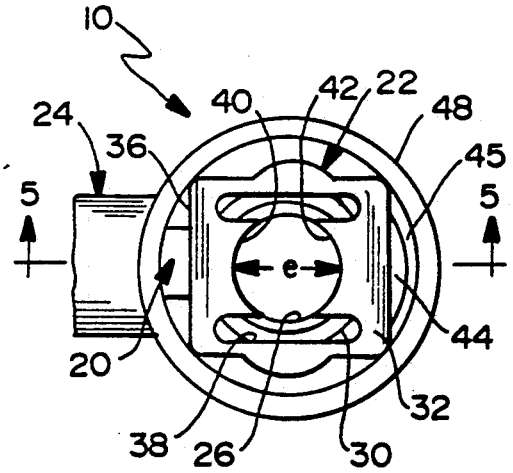
FIG. 4 is an elevational view of the electrical connector assembly with the actuator in a biased position.
Figure 5:
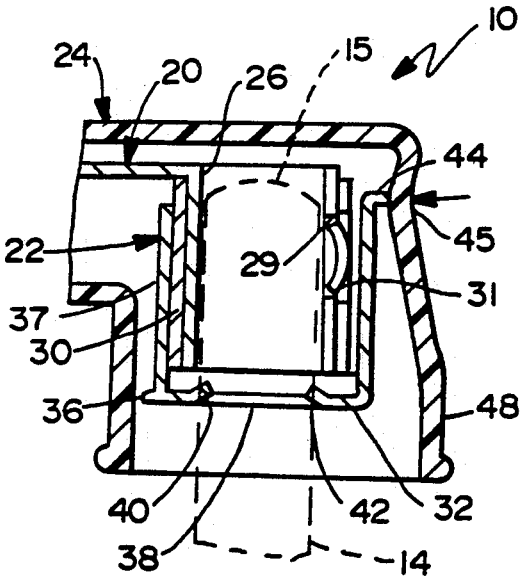
FIG. 5 is a cross-sectional view taken along line 5—5 in FIG. 4.

When the male terminal engaging portion 32 is perpendicular to the pin 14, the arcuate gripping edges 40 and 42 define a diameter "e" which is equal to or slightly greater than the diameter "a" of the pin 14 on the vehicular alternator. In view of the diametrical dimension "e", the aperture 38 can be slid over the pin 14 when the male terminal engaging portion 32 is biased into an alignment substantially orthogonal with the longitudinal axis of the female terminal engaging portion 30, as shown in FIGS. 4 and 5. However, as the biasing forces on the actuator 34 and the male terminal engaging portion 32 are released, the male terminal engaging portion 32 will resiliently rotate about the hinge 36 back toward an unbiased condition non-orthogonally aligned to the longitudinal axis of the female terminal engaging portion 30, as shown in FIGS. 1–3. In this non-orthogonal alignment, the gripping edges 40 and 42 will be urged into gripping engagement with the peripheral surface of the pin 14. The gripping edges 40 and 42 are of bevelled configuration as shown in FIGS. 1, 3 and 5 to define sharp leading edges which bite into the outer peripheral surface of the pin 14 to positively retain the spring clip 22 on the pin terminal 14 of the vehicular alternator. With this combination, the female terminal engaging portion 30 of the spring clip 22 will securely retain and engage the split cylindrical sleeve 26 of the terminal 20. Additionally, the gripping portions 40 and 42 of the male terminal engaging portion 32 will securely and positively engage the alternator pin 14 to prevent unintentional separation of the terminal 10 therefrom.

The actuator 34 of the spring clip 22 is substantially rigidly connected to the male terminal engaging portion 32 to prevent relative deflection therebetween. The rigid connection is achieved by the arcuate configuration of the actuator 34 at its intersection with the planar male terminal engaging portion 32. The actuator 34 is aligned approximately orthogonally to the male terminal engaging portion 32 and approximately parallel to the split cylindrical sleeve defining the female terminal engaging portion 30. The actuator 34 terminates at an outwardly extending actuator ridge 44 which defines a portion of the actuator that can be conveniently urged inwardly and toward the female terminal engaging portion 30. The ridge 44 has an arcuate outer edge 45 which conforms to the shape of the boot 24 as shown in FIGS. 3 and 5. This inward movement of the actuator 34 will cause a corresponding pivoting movement of the male terminal engaging portion 32 about the hinge 36.

The elastomeric boot 24 of the connector 10 defines a wire engaging portion 46 which closely engages and is positively retained on the wire 12 and the wire engaging portion 28 of the terminal 20. Preferably, the terminal 20 and portions of the wire 12 adjacent thereto are insert molded into the wire engaging portion 46 of the boot 24.

The boot 24 further includes a mating end 48 of generally cylindrical configuration which is dimensioned to substantially surround the split cylindrical sleeve 26 of the terminal 20 and the spring clip 22. The boot 24 preferably is formed from a very flexible elastomeric material, such as silicon rubber. As a result, an inward movement on the mating end 48 of the boot 24 will readily deflect the elastomeric material thereof. In this manner, inward forces on the mating end 48 of the boot 24 can generate contact on the outer edge 45 of the actuator ridge 44 of the spring clip 22. These inward forces will cause the male terminal engaging portion 32 to rotate into substantially orthogonal alignment to the longitudinal axis of the female terminal engaging portion 30, as shown in FIGS. 4 and 5, thereby enabling and facilitating the intentional removal of the connector assembly 10 from the alternator pin 14.

It will be appreciated that the selected mating or unmating of the terminal 10 with the alternator pin 14 does not require the use of special tools, and can be completed by a mechanic easily with one hand. The boot 24 provides protection of the electrical connection from moisture and dirt, and further prevents direct contact with the high current in the alternator pin 14. In addition to performing this protective function, the boot 24 defines the manual activating means for effecting disengagement or engagement of the connector assembly 10 with the terminal 14.

It will also be appreciated that the spring clip 22 performs the dual function of both enhancing the quality of the electrical connection between the terminal 20 and the pin 14 and also positively retaining the terminal 20 in a mated condition with the terminal 14, including high normal contact forces therebetween, and a large surface contact area.

In summary, an electrical connector assembly is provided for achieving high quality electrical connection with a vehicular alternator, or with any other pin or post terminal. The electrical connector is particularly well suited for use in a high vibration environment, and/or a vibration subject to high ambient moisture conditions or periodic splashing of liquids. Additionally, the connector enables quick connection and disconnection, which positively preventing accidental separation of the connector assembly from the pin terminal of the alternator or the like. The connector assembly includes a terminal having a wire mounting end and a split sleeve cylindrical mating end. The terminal preferably is formed from a material having high conductivity, with the high conductivity generally being at the expense of high resiliency. The connector further includes a spring clip having a split cylindrical sleeve female terminal engaging portion dimensioned for being slidably telescopingly received over the split cylindrical sleeve at the mating end of the terminal. A male terminal engaging portion is hingedly connected to the female terminal engaging portion and includes an aperture for receiving the pin terminal. The male terminal engaging portion is disposed at an angle to the longitudinal axis of the female terminal engaging portion and is dimensioned to grippingly engage the pin of the alternator in that unbiased condition. However, the male terminal engaging portion can be biased into perpendicular alignment with the female terminal engaging portion, and in that perpendicular alignment the pin terminal of the alternator can advance through the aperture in the male terminal engaging portion and into the split cylindrical sleeve of the terminal. Deflection of the male terminal engaging portion is achieved by an actuator extending unitarily therefrom. An elastomeric boot is disposed over the terminal, and includes a mating portion that is readily deflectable to cause deflection of the male terminal engaging portion to enable mating or unmating of the connector with the alternator pin.

While the invention has been described with respect to a preferred embodiment, it is apparent that various changes can be made without departing from the scope of the invention as defined by the appended claims. In particular, other means for deflecting the male terminal engaging portion relative to the female terminal engaging portion may be provided. Similarly, different gripping configurations for the male terminal engaging portions of the spring clip may also be provided.

I claim:

1. An electrical connector for mounting to a pin terminal in a high vibration environment, said connector including a connector terminal having a wire engaging end mounted to a wire and a mating end for engaging the pin terminal, wherein the improvement comprises:

the mating end of the connector terminal defines a split sleeve dimensioned to resiliently engage the pin terminal;

a spring clip comprising a split sleeve for sliding telescoping engagement over the split sleeve of the terminal, a pin engaging portion hingedly connected to the split sleeve of the spring slip and resiliently deflectable relative thereto, such that in an unbiased condition said pin engaging portion grippingly engages a pin disposed in the split sleeve of the terminal, and such that said pin engaging portion can be biased into a position to permit slidable movement of the split sleeve of the terminal over the pin the spring clip further including an actuator extending from the pin engaging portion for deflecting the pin engaging portion relative to the split sleeve of the spring clip.

2. An electrical connector as in claim 1 wherein the split sleeves of the terminal and the spring clip are generally cylindrical.

3. An electrical connector as in claim 1 wherein the terminal is stamped and formed for a unitary piece of a first metal, and wherein the spring clip is stamped and formed from a second metal.

4. An electrical connector as in claim 3 wherein the metal of the spring clip exhibits higher resiliency than the metal of the terminal.

5. An electrical connector as in claim 4 wherein the metal of the terminal exhibits higher electrical conductivity than the metal of the spring clip.

6. An electrical connector as in claim 5 wherein the spring clip comprises stainless steel.

7. An electrical connector as in claim 6 wherein the terminal comprises a highly conductive brass alloy.

8. An electrical connector as in claim 1 further comprising an elastomeric boot surrounding and engaging the wire and portions of the terminal mounted thereto, said boot further including a mating end surrounding and protecting the terminal and the spring clip, portions of the boot adjacent the spring clip being deflectable to enable deflection of the pin engaging portion of the spring clip for facilitating mating and unmating of the connector to the pin.

9. An electrical connector as in claim 8 wherein the boot is insert molded around the wire and portions of the terminal mounted to the wire.

10. An electrical connector for mounting to the pin of a vehicular alternator, said connector including a wire mounting end mounted into electrical connection with pin of the alternator, wherein the improvement comprises:

the mating end of the terminal defining a generally cylindrical split sleeve dimensioned to be telescopingly engaged over the pin of the alternator;

a spring clip having a split cylindrical sleeve telescopingly engaged over the split cylindrical sleeve of the terminal for contributing to the resiliency of the mating end of the terminal, said spring clip further including a pin engaging portion hingedly connected to the split cylindrical sleeve of the spring clip and being resiliently deflectable relative thereto, the pin engaging portion including an aperture extending therethrough, said aperture being dimensioned to permit slidable movement of the alternator pin into the split cylindrical sleeve of the terminal in a biased position of the pin engaging portion relative to the split cylindrical sleeve of the spring clip, and being dimensioned to grippingly engage the alternator pin as the pin engaging portion returns toward an unbiased condition, said spring clip further comprising an actuator portion extending substantially rigidly from said pin engaging portion for facilitating deflection of the pin engaging portion relative to the split cylindrical sleeve of the spring clip; and an elastomeric boot surrounding and engaging portions of the terminal mounted to the wire and further surrounding the spring clip and portions of the terminal engaged therein, whereby deflection of portions of said boot surrounding the spring clip generates deflection of the actuator and the pin engaging portion of the spring clip for enabling relative movement between the connector and the alternator pin.

11. An electrical connector as in claim 10 wherein the split cylindrical sleeve of the terminal defines an internal diameter which is less than the diameter of the pin of the alternator, such that the split cylindrical sleeves of the terminal and the spring clip are resiliently deflected generally radially outwardly upon engagement of the connector with the alternator pin.

12. A connector as in claim 10 wherein the spring clip is stamped and formed from stainless steel, and wherein the terminal is stamped and formed from a unitary piece of material exhibiting less resiliency than the spring clip.

13. A connector as in claim 12 wherein the terminal is stamped and formed from a tin plated highly conductive brass alloy.

* * * * *